United States Patent [19]

Harris

[11] Patent Number: 4,828,290

[45] Date of Patent: May 9, 1989

[54] PERPETUAL CALENDAR WHICH UTILIZES SEVEN MONTH TABLES AND METHODS OF CONSTRUCTING AND USING THE SAME

[76] Inventor: Gary J. Harris, 28401 Lakeshore Blvd., Willowick, Ohio 44094

[21] Appl. No.: 141,972

[22] Filed: Jan. 11, 1988

[51] Int. Cl.[4] ..... B42D 15/00; B42D 5/04; G09D 3/00; G09D 3/10

[52] U.S. Cl. ..... 283/67; 283/2; 40/107; 40/109

[58] Field of Search ..... 283/1, 2, 5, 67; 40/107, 109, 113, 115, 121; 434/408, 416

[56] References Cited

U.S. PATENT DOCUMENTS

| | | | |
|---|---|---|---|
| 1,905,846 | 4/1933 | Furedi | 40/109 |
| 2,588,795 | 3/1952 | Bauer | 40/107 |
| 2,847,778 | 8/1958 | Opoczymski | 40/109 |
| 3,166,862 | 1/1965 | Jaickles | 40/109 |
| 3,427,740 | 2/1969 | Heskes | 40/109 |
| 3,800,454 | 4/1974 | Anderson | 40/109 |
| 4,221,064 | 9/1980 | Sebastian | 40/109 |
| 4,285,147 | 8/1981 | Kolar | 40/109 |

*Primary Examiner*—Frank T. Yost
*Assistant Examiner*—Paul M. Heyrana, Sr.
*Attorney, Agent, or Firm*—Daniel J. Hudak Co.

[57] ABSTRACT

The invention relates to a pocket calendar which is perpetual and which utilizes two arrays of elements. The first array has coordinates corresponding to the decade and the year. The elements of the array are one of fourteen designators. The second array has coordinates which correspond to the twelve months and to one of seven 31-day month tables which each begin on one of the seven days of the week. Each element of the second array is comprised of two of the designators of the first array. The location of the designator in the second array indicates the month table for the month in question. Funnels direct the user's attention to the proper month table.

14 Claims, 2 Drawing Sheets

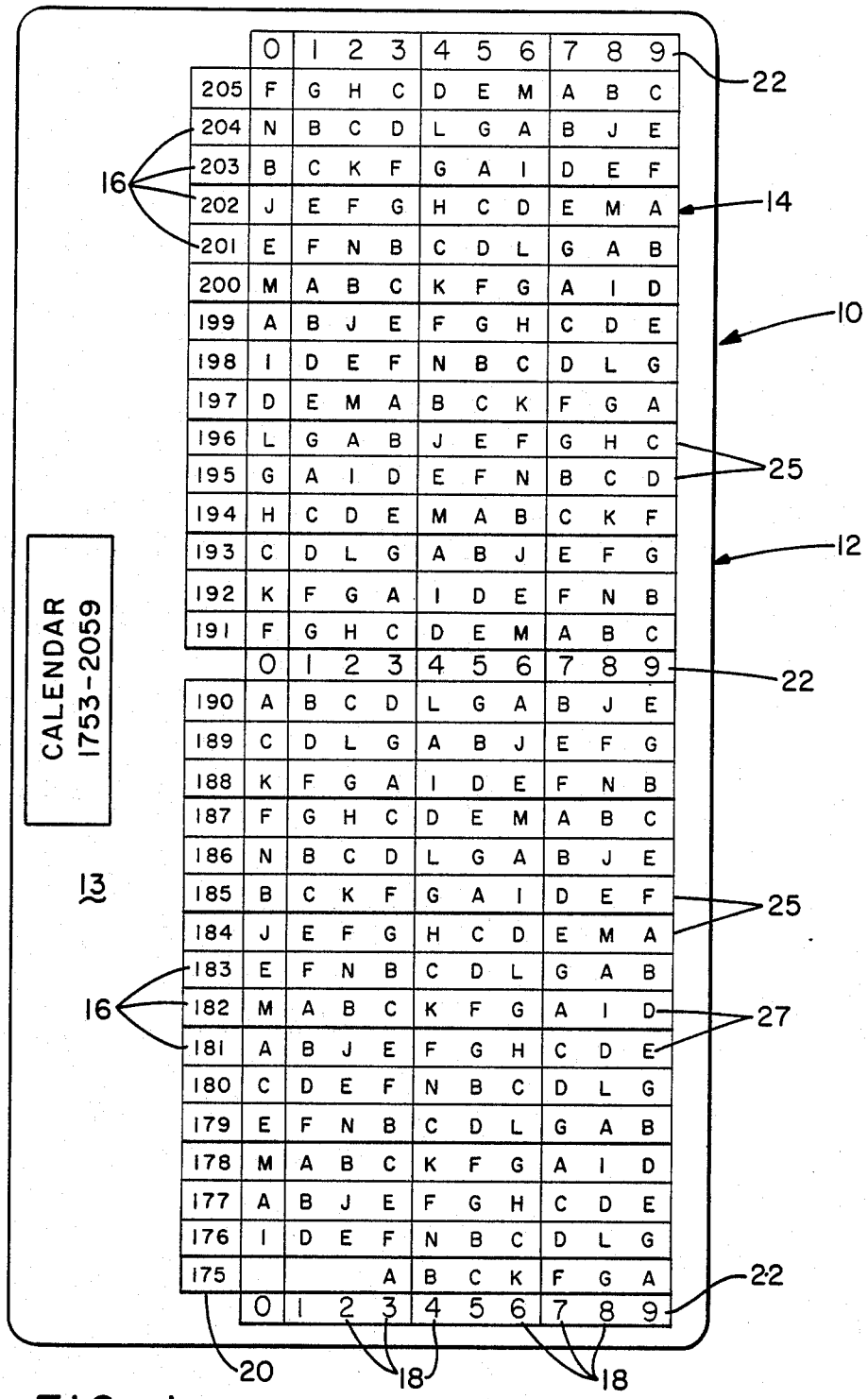

| | 0 | 1 | 2 | 3 | 4 | 5 | 6 | 7 | 8 | 9 |
|---|---|---|---|---|---|---|---|---|---|---|
| 205 | F | G | H | C | D | E | M | A | B | C |
| 204 | N | B | C | D | L | G | A | B | J | E |
| 203 | B | C | K | F | G | A | I | D | E | F |
| 202 | J | E | F | G | H | C | D | E | M | A |
| 201 | E | F | N | B | C | D | L | G | A | B |
| 200 | M | A | B | C | K | F | G | A | I | D |
| 199 | A | B | J | E | F | G | H | C | D | E |
| 198 | I | D | E | F | N | B | C | D | L | G |
| 197 | D | E | M | A | B | C | K | F | G | A |
| 196 | L | G | A | B | J | E | F | G | H | C |
| 195 | G | A | I | D | E | F | N | B | C | D |
| 194 | H | C | D | E | M | A | B | C | K | F |
| 193 | C | D | L | G | A | B | J | E | F | G |
| 192 | K | F | G | A | I | D | E | F | N | B |
| 191 | F | G | H | C | D | E | M | A | B | C |
| | 0 | 1 | 2 | 3 | 4 | 5 | 6 | 7 | 8 | 9 |
| 190 | A | B | C | D | L | G | A | B | J | E |
| 189 | C | D | L | G | A | B | J | E | F | G |
| 188 | K | F | G | A | I | D | E | F | N | B |
| 187 | F | G | H | C | D | E | M | A | B | C |
| 186 | N | B | C | D | L | G | A | B | J | E |
| 185 | B | C | K | F | G | A | I | D | E | F |
| 184 | J | E | F | G | H | C | D | E | M | A |
| 183 | E | F | N | B | C | D | L | G | A | B |
| 182 | M | A | B | C | K | F | G | A | I | D |
| 181 | A | B | J | E | F | G | H | C | D | E |
| 180 | C | D | E | F | N | B | C | D | L | G |
| 179 | E | F | N | B | C | D | L | G | A | B |
| 178 | M | A | B | C | K | F | G | A | I | D |
| 177 | A | B | J | E | F | G | H | C | D | E |
| 176 | I | D | E | F | N | B | C | D | L | G |
| 175 | | | | A | B | C | K | F | G | A |
| | 0 | 1 | 2 | 3 | 4 | 5 | 6 | 7 | 8 | 9 |

FIG.-1

PERPETUAL CALENDAR WHICH UTILIZES SEVEN MONTH TABLES AND METHODS OF CONSTRUCTING AND USING THE SAME

FIELD OF THE INVENTION

The invention relates to a perpetual calendar, and more specifically, to a perpetual calendar which is a pocket size novelty item and which utilizes two arrays, one corresponding to the year and one corresponding to seven 31 day month tables linked to the second array by funnels. The funnels facilitate the use of the calendar.

BACKGROUND

Calendars are used as systems for measuring time into common units. Ancient calendars are based on the movements of the earth and the appearances of the moon and the sun. The present invention is intended for use with the Gregorian calendar which is currently in use throughout Europe and most of the western world. This system approximates the solar year which is the amount of time necessary for the earth to complete one revolution around the sun. A solar year contains 365 days, 5 hours, 48 minutes, and 45.5 seconds. The Gregorian calendar compensates for the partial day by having three 365 day common or non-leap years followed by a 366 day leap year. Additionally, since there remains an 11 minute discrepancy per year, the Gregorian calendar provides that century years which are evenly divisible by 400 are leap years, while other century years are common years (i.e., not a leap year). The use of the leap years in this system complicates calculation of the days corresponding to dates over a wide range of time. The present invention can be used for periods beginning in 1752 since there was a correction eliminating eleven days from Sept. 2, 1752 until Sept. 14, 1752.

Heretofore, perpetual calendars have been known that either utilize at least 12 month tables or which have only a single table of 31 days so that only one day at a time is revealed to the user.

SUMMARY OF THE INVENTION

It is therefore an aspect of the present invention to provide a perpetual calendar, i.e., a system for finding the month table for any month falling in an extended period. This period is usually longer than thirty-one years, the number of years that it takes the sequence of month tables to repeat. Moreover, it is common for such calendars to begin after 1752. The invention is useful since it consolidates the month tables to seven by utilizing a first array of years having elements which are designators, and a second array of months where the elements are designators which indicate the appropriate month table. The second array includes columns which funnel the users attention to the appropriate month table. The calendar is printed on a suitably stiff and durable flat material of appropriate dimensions to be kept in a pocket. The first array is printed on the first side and the second array is printed on the second side. The invention also comprises a method of constructing a perpetual calendar and a method of determining the month table for a predetermined year.

BRIEF DESCRIPTION OF THE DRAWINGS

FIG. 1 is a front plan view of the calendar in accordance with the invention including the first array.

DETAILED DESCRIPTION OF THE INVENTION

Figure 2:
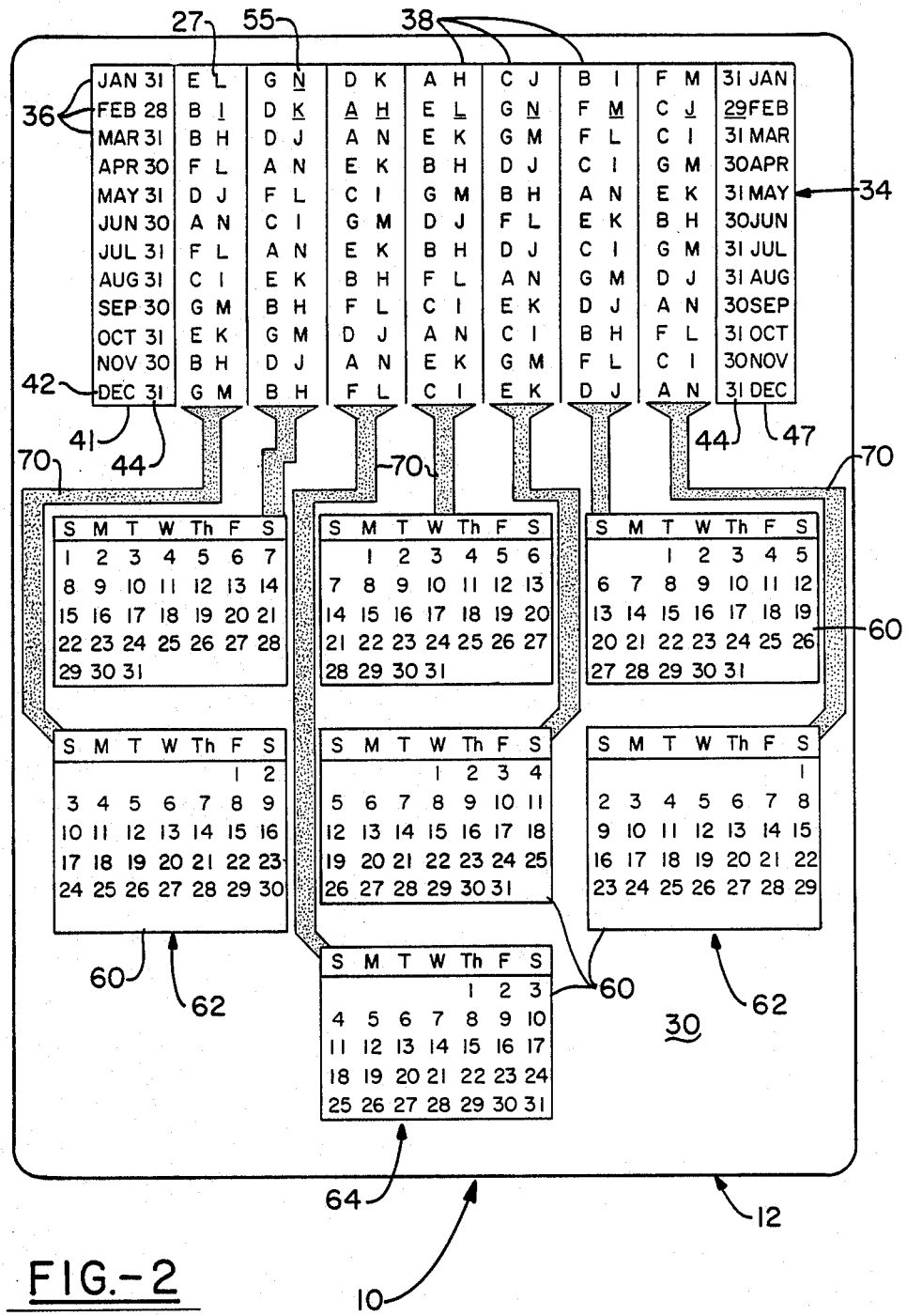
FIG. 2 is a back plan view of the calendar in accordance with the invention including the second array and the corresponding linked month tables.

The calendar system of the present invention is shown generally at 10 and includes a flat two-sided card 12 comprised of a suitably stiff and durable material, such as plastic, and being an appropriate size for a pocket, for example a size which approximates the size of a customary business card. A suitable range is 1.5 to 2.5 inches wide and 2.5 to 3.5 inches long and of any suitable thickness. Of course, it should be understood that the calendar system could also be used on a surface of a larger size. The calendar system of the present invention, however, is useful as the configuration is suitable for use on a novelty card of a customary size while preserving the ease of use.

The calendar system includes on one side 13 a first array 14. The horizontal and vertical determinators, or coordinates 15 indicate the year. More specifically the rows 15 indicate the decade and the columns 18 indicate the specific year in the decade. The rows include a set of three digit decade labels 20 on the left of the array and one or more sets of year labels 22. The elements 25 of the array are selected from a group of fourteen designators 27 that are used in conjunction with the second array to find the appropriate month table. As used in this disclosure the term element means the entries at the locations within the arrays while designators means the set of symbols which may be used as elements. In this case the designators are the letters A through N. Of course it should be understood that the array may be set up with the coordinates reversed so that the columns 18 indicate the decade and the rows 16 indicate the year.

On the second side 30 of the card 12, a second side array 34 has coordinates which are rows 36 and columns 38 corresponding to the twelve months of the year and to seven month tables. The array 34 is illustrated with the rows 36 determining the months and the columns 38 determining the seven month tables. However, the coordinates could be reversed so that the array 34 could also be set up with the columns corresponding to the months and the rows corresponding to the month tables.

The first column 41 has twelve elements consisting of the month names to comprise a month label 42. The month names include an indicator 44 for each month which indicates the number of days for that month. As illustrated, the array includes a last column 47 on the far right of the array which also has the month names as its elements to form a second month label corresponding to the first except that the indicator 44 for February is 29 rather than 28 and is underlined to indicate that there are 29 days in February during leap years.

Intermediate to the first and the last column are seven columns 38 which include an element 55 for each location. The elements comprise two designators selected from the set of fourteen designators 27 used in the first array 14. For the row 47 corresponding to the month of February, the designators which indicate a leap year are underlined similarly to the indicator in the month label 48.

Below the second array 34 are the seven month tables 60 which have column labels indicating the day and rows comprising consecutive listing of dates from 1–31. The tables each begin with a different one of the seven days of the week. The tables 60 are laid in a plan so that they fit neatly in the remaining space on the card 12. This is facilitated by placing the tables in two columns 62 of two and one 64 of three where the two tables having six rather than five rows of dates are placed one in each of the two table columns 62.

Funnels or channels 70 follow from the bottom of the columns 38 of the second array to the appropriate month table. These funnels facilitate the use of the array to locate the appropriate month table for any given month as has been determined by the designator found in the first array 14.

The calendar also includes instructions for its use and an example.

The calendar in accordance with the invention may be constructed as follows: a material is selected for the card which is suitably stiff and durable, such as a lightweight plastic. The material is indelibly marked with the first array on a first side and the second array and the month tables on the second side and the material is formed into the card of the appropriate size, such as by die stamping sheet stock which has already been marked.

The following is an example of how to use the calendar in accordance with the invention to find the appropriate month table for a given month and year. The user begins with the predetermined year and locates the decade from the row 16 in the first array 14 and then the user locates the specific year in the year label column 18. The element at the intersection of the coordinates constitutes the designator 27 for the predetermined year. The user then turns to the second side 30 of the card 12 and locates the desired month in one of the month label columns 41 of the second array 34. The user proceeds to the column 38 which includes the designator from the first array 14. The user follows the column to the bottom as it ends in the funnel which leads to the month table for the predetermined month. The user thus can view the entire month for any given month and year. The day indicator at the right of the month prompts the user as to the proper number of days. When Februrary is a leap year, the indicator is underlined to correspond with the underlined indicator for February in the second month label column.

While in accordance with the Patent Statutes, the best mode and preferred embodiment have been set forth, the scope of the invention is not limited thereto, but rather by the scope of the attached claims.

What is claimed is:

1. A perpetual calendar for determining the month table for a given month and year comprising:

a first array having a set of elements arranged in rows and columns and a set of first coordinates and a set of second coordinates which indicate intersections each of which determines the year, said array having elements at the intersections determined by the first and second coordinates, said elements being selected from a group of designators;

a group of seven month tables each having consecutive date listings from 1–31 arranged to seven columns to correspond to the seven days of the week and in the appropriate number of rows, and said seven tables each beginning with the data 1 on a different day of the week;

a second array having a set of elements arranged in rows and columns a set of first coordinates which determine the month, and a set of second coordinates which determine the corresponding month table, each element of the second array being two designators selected from said group of designators; and said calendar comprises a flat two-sided solid card, said first array being marked on one side and said second array being marked on the other side.

2. A perpetual calendar according to claim 1 wherein the set of first coordinates in the first array determine a decade and the set of second coordinates determine the year.

3. A perpetual calendar according to claim 1, including seven funnels, wherein seven funnels correspond to each member of said set of second coordinates and to each of said seven month tables to facilitate the use of the calendar.

4. A perpetual calendar according to claim 2, wherein the set of first coordinates for the first array determine the row and the set of second coordinates of the first array determine the column, and the set of first coordinates for the second array determine the row corresponding to a month and the set of second coordinates for the second array determine the column, and funnels lead from the columns of the second array to the seven month tables.

5. A perpetual calendar according to claim 4, wherein the number of designators is fourteen, wherein two of said seven month tables have six rows in the date listing and five of said seven month tables have five rows in the data listing, and the month tables are arranged in three columns having two columns with two month tables, each of said two columns having one of the month tables with six rows.

6. A pocket perpetual calendar for determining the month table for a given month and year comprising:

a card having a first and second side and a width of from about 1.5 to about 2.5 inches and a length of from about 2.5 to about 3.5 inches and comprised of a durable material;

said first dide including an indelible first array having a set of elements arranged in rows and columns and a set of first coordinates and a set of second coodinates which indicate intersections each of which determines the year, said array having elements at the intersections indicated by the first and second coordinates, said elements being selected from a group of designators; and said second side having an indelible group of seven month tables each having consecutive date listings from 1–31 arranged in seven columns to correspond to the seven days of the week and in the appropriate number of rows, and said seven tables each beginning with the date 1 on a different one of said seven days, said second side further having an indelible second array having a set of elements arranged in rows and columns and set of first coordinates which determine the month, and a set of second coordinates which determine the corresponding month table, each element of the second array being two designators selectedfrom said group of designators, and seven funnels leading from said second array to said month tables.

7. A perpetual calendar according to claim 6, wherein the set of first coordinates in the first array determine a decade and the set of second coordinates determine the year.

8. A perpetual calendar according to claim 7, wherein the set of first coordinates for the first array determine the row and the set of second coordinates of the first array determine the column, and the set of first coordinates for the second array determine the row and the set of second coordinates for the second array determine the column, and funnels lead from the columns of the second array to the seven month tables.

9. A perpetual calendar according to claim 6, wherein said first array being marked on the first side and said second array and said month tables being marked on the second side, and wherein the total number of designators is fourteen.

10. A perpetual calendar according to claim 6, wherein said card is plastic.

11. A method of constructing a perpetual calendar comprising the steps of:

marking one side of a sheet with a first array having a set of first coordinates and a set of second coordinates which indicate intersections which each determine a year, said array having elements arranged in rows and columns at the intersections determined by the first and second coordinates, said elements being selected from a group of designators, marking a second side of the sheet with a group of seven month tables each having consecutive date listings from 1–31 arranged in seven columns to correspond to the seven days of the week and in the appropriate number of rows, and said seven tables each beginning with the date 1 on a different day of the week and with a second array having a set of elements arranged in rows and columns and a set of first coordinates which determine a month and a set of second coordinates which determine the corresponding month table, each element of the second array being two designators selected from said group of designators, and funnels linking the second array and the month tables; and forming a card from said material being so marked.

12. A method according to claim 11 wherein said material is plastic and said forming step is performed by stamping said card from the plastic.

13. A method of determining a month table for a given month and year comprising the steps of:

selecting a designator for each year, said designator being located at the intersection determined by two sets of coordinates of a first array, said coordinates together determining said year; and locating said designator for said month within a second array wherein a set of first coordinates indicate the month and a set of second coordinates indicate one of seven funnels leading to seven month tables each beginning on a different day of the week.

14. A perpetual calendar according to claim 4, wherein said card has a width of from about 1.5 to about 2.5 inches and a length of from about 2.5 to about 3.5 inches.

* * * * *